US005350228A

United States Patent [19]

Remington

[11] Patent Number: 5,350,228

[45] Date of Patent: Sep. 27, 1994

[54] ELECTROSTATIC DISCHARGE PROTECTIVE WORKSTATION AND METHOD OF MAKING SAME

[75] Inventor: John L. Remington, Coplay, Pa.

[73] Assignee: The Stanley Works, New Britain, Conn.

[21] Appl. No.: 4,700

[22] Filed: Jan. 14, 1993

[51] Int. Cl.[5] ..... A47B 81/00

[52] U.S. Cl. ..... 312/223.1; 361/220

[58] Field of Search ..... 312/223.3, 223.1; 361/212, 220; 252/62.3 R

[56] References Cited

U.S. PATENT DOCUMENTS

| | | | |
|---|---|---|---|
| 3,132,065 | 5/1964 | Barsy | 361/220 |
| 4,363,071 | 12/1982 | Rzepecki | 361/220 |
| 4,456,944 | 6/1984 | Rooklyn | 361/212 |
| 4,557,379 | 12/1985 | Lawe | 361/212 |
| 4,642,727 | 2/1987 | Dalal | 361/220 |
| 4,649,374 | 3/1987 | Hoigaard | 361/220 |
| 5,201,415 | 4/1993 | Metz | 312/223.1 |

FOREIGN PATENT DOCUMENTS

| | | | |
|---|---|---|---|
| 2587872 | 3/1987 | France | 312/208.3 |

OTHER PUBLICATIONS

Worksurfaces-Resistive Characterization EOS/ESD-S4.1-1990 Apr. 1990.

ESD Protective Workstations EOS/ESD DS10.1-199X Draft dated Sep. 13, 1992.

Static Guard ESD Safe Storage and Workstations dated Jun. 1, 1991 at page 13.

"Electrostatic Discharge: What it is, What it does, What you can do about it" dated Sep. 1991.

*Primary Examiner*—Kenneth J. Dorner

*Assistant Examiner*—Gerald A. Anderson

*Attorney, Agent, or Firm*—Woodcock Washburn Kurtz Mackiewicz & Norris

[57] ABSTRACT

An electrostatic discharge protective workstation and method of making the same wherein the workstation includes a metal cabinet having drawers and/or shelves constructed for a static-safe work environment so that the metal cabinet conforms with the standard resistivity ranges for static dissipative control. The metal parts of the cabinet have a dielectric base paint coat of a thickness of about 0.4 to 0.6 mils and an outer coat of an electrostatic dissipative paint having a thickness of about 0.7 to about 0.9 mils.

14 Claims, 1 Drawing Sheet

ELECTROSTATIC DISCHARGE PROTECTIVE WORKSTATION AND METHOD OF MAKING SAME

BACKGROUND OF THE INVENTION

The present invention relates to electrostatic discharge protective workstations and particularly the metal components thereby comprising metals cabinets, drawers and shelves; and particularly the method of making the electrostatic discharge protective workstations conform with the EOS/ESD standard for protection of electrostatic discharge susceptible items.

Commonly known as static electricity, electrostatic discharge (ESD) is a transfer of electrons when two objects with dissimilar charges touch, rub, come close together, or are separated. Most objects have dissimilar charges affected by movement, low humidity, and the nature of the material itself. Some of the most common contributors are people, through ordinary activities and synthetic materials such as plastics. Wherever electronic components and spare parts are kept or used, electrostatic discharge damage can occur. The further into the manufacturing process that the damaged component is introduced, the more costly the consequences. As electronic products grow in sophistication, they become more and more sensitive, and are used in increasingly critical and costly applications. As a result, when they fail, the damage can be expensive. One uncontrolled electrostatic discharge can cause partial damage whose effects may not be discovered for months or years or it can cause total destruction, affecting not only the host component, but spreading to others within the system as well. Wherever critical electronic parts are stored and used for today's electronics-driven products and equipment, there is the risk of failure due to electrostatic discharge.

To aid manufacturers to minimize and/or eliminate the effects of electrostatic discharge, the Electrical Over Stress/Electrostatic Discharge (EOS/ESD) Association, Inc. formulated recommended standards to industry for solving electrostatic discharge problems. In 1990, the EOS/ESD Association formulated the standard for worksurfaces, EOS/ESD-S4.1-1990-worksurfaces-resistive characterization. The purpose of an ESD-protective worksurface is to aid in the prevention of damage to ESD-susceptible parts. There are several ways these surfaces may act to provide this protection. One involves the removal of charge residing on the surface of the material. A second charge-removal task involves the charge on an object such as a tote box that is placed on the surface. In this case, the charge must flow across the zone between the object and the worksurface, which can interpose a considerable contact resistance. A third charge removal task involves current flow from a charge-susceptible device placed on the surface. In this case, a low discharge current may be desirable.

The degree of protection afforded by a worksurface is strongly related to the time needed to discharge an object. In practice, some form of resistance value is commonly given as an indication of the effective charge removal characteristics of the worksurface. However, this description is incomplete since discharge time depends on several other factors, such as the effective capacitance of the worksurface, contact resistance and the actual discharge path. (The capacitance does not usually vary as much as resistance.) The other effects are very dependent on the individual situation. As a result, resistance is believed to be the best single predictor of performance of ESD-protective worksurfaces. The aforementioned standard relies on resistive measurements, utilizing standard instruments, to provide a means of evaluating materials or installed worksurfaces.

To provide the convenience of a single location for maintenance and storage of small static-sensitive assembly parts and tools, electrostatic discharge protective equipment was developed specifically for a static-safe work environment. Such equipment included electrostatic workstations comprising worksurfaces, cabinets and drawers, and shelves. It should be noted that the worksurfaces normally are non-metallic materials whereas the cabinets, drawers and shelves may be made of metal. Early electrostatic dissipative cabinets were standard metal cabinets to which the customer attached a ground cord with a one megohm resistor built in. The other end was then connected to a hard ground (water pipe, cooper rod, etc.). This system was used to divert an electrostatic charge from the user's body to ground when he touched the handle of the cabinet. The one megohm resistor protected the user from a high amperage charge if the circuitry was contacted by high electrical energy. However, if the user did not touch the handle, he would by-pass the grounding circuitry and create a potential for damage to anything he touched in the cabinet and/or drawer. Later, plastic manufacturers were spraying their non-conductive plastic components (not working surfaces) with semi-conductive coatings to provide electrostatic discharge protection. It was found that some of these semi-conductive paints when applied to metal cabinets had favorable results at voltages around 10 V DC.

Starting before and during this period, the EOS/ESD Association was being formed as a body to provide specifications and guidance to this new industry. Because of the need for industry to achieve higher voltage protection and also the Department of Defense, the Association began developing test specifications for worksurfaces at both 10 V DC and 100 V DC. The implication of the worksurface testing standard increasing to 100 V DC would have no effect on products made of plastic but would affect products (steel cabinets, etc.) made of steel. The plastic products had a built in dielectric layer and, thus, were not susceptible to effects of any breakdown of the surface coating to the base component at 100 V DC. In the case of metal cabinets, since the electrostatic discharge paint was applied directly to conductive steel, it was recognized that there would be a potential problem when the specifications for components other than the worksurface were approved by the EOS/ESD Association. At voltages up to 10 V DC, the semi-conductive paint on the metal cabinets was satisfactory, however, when the voltage was increased to 100 V DC, the conductive coating broke down and the charge went directly to the base conductive steel thereby defeating the controlled conductive properties of the electrostatic dissipative coating.

After extensive development and testing, there has been developed in accordance with the present invention a method of making an electrostatic workstation where all of the parts thereof conform with the standard in EOS/ESD-S4.1-1990 and Draft EOS/ESD-DS10.1-199X. (The draft standard is still unfinished as of the filing date of this application). This standard is incorporated herein by this reference thereto. The standard requires that electrostatic discharge protective cabinets, accessories and worksurfaces perform within the static dissipative range of point-to-point resistance of $10^6$–$10^{10}$ ohms and point-to-ground resistance of $10^6$–$10^{10}$ ohms at 10 V DC and 100 V DC so as to provide static dissipation as well as protection against electrostatic overstress on all internal and external static dissipative surfaces.

SUMMARY OF THE INVENTION

In accordance with the invention, there is provided a method of making the metal components of an electrostatic discharge protective work-station, comprising metal cabinets, drawers and/or shelves, conform with the standard resistivity ranges for static dissipative control point-to-point resistance of $10^6$–$10^{10}$ ohms and point-to-common-point ground resistance of $10^6$–$10^{10}$ ohms at 10 V DC and 100 V DC. The method comprises the steps of precleaning and drying the metal parts of the cabinets, drawers and shelves, coating the metal parts with a dielectric base paint coat to a thickness of about 0.4 to about 0.6 mils measured dry after curing, and thereafter coating the base coated metal parts with an electrostatic dissipative paint to a thickness of about 0.7 to about 0.9 mils measured dry after curing.

In accordance with a further aspect of the invention there is provided an electrostatic discharge protective workstation comprising metal cabinets, drawers and/or shelves constructed for a static-safe work environment so that the metal cabinet, drawers and shelves conform with the standard resistivity ranges for static dissipative control point-to-point resistance of $10^6$–$10^{10}$ ohms and point-to-common point ground resistance of $10^6$–$10^{10}$ ohms at 10 V DC and 100 V DC wherein the metal parts of the cabinets, drawers and shelves have a dielectric base paint coat of a thickness of about 0.4 to about 0.6 mils and an outer coat of an electrostatic dissipative paint having a thickness of about 0.7 to about 0.9 mils.

In accordance with another aspect of the invention, there is provided a method of making a metal cabinet having drawers and/or shelves suitable for use in an electrostatic discharge protective work-station conform with the standard resistivity ranges for static dissipative control point-to-point resistance of $10^6$–$10^{10}$ ohms and point-to-common-point ground resistance of $10^6$–$10^{10}$ ohms at 10 V DC and 100 V DC. The method comprises the steps of precleaning and drying the metal parts of the cabinet coating the metal parts with a dielectric base paint coat to a thickness of a bout 0.4 to about 0.6 mils measured dry after curing, and thereafter coating the base coated metal parts with an electrostatic dissipative paint to a thickness of about 0.7 to about 0.9 mils measured dry after curing.

In accordance with a further aspect of the invention, there is provided an electrostatic discharge protective metal cabinet having drawers and/or shelves constructed for a static-safe work environment so that the metal cabinet conforms with the standard resistivity ranges for static dissipative control point-to-point resistance of $10^6$–$10^{10}$ ohms and point-to-common point ground resistance of $10^6$–$10^{10}$ ohms at 10 V DC and 100 V DC wherein the metal parts of the cabinet have a dielectric base paint coat of a thickness of about 0.4 to about 0.6 mils and an outer coat of an electrostatic dissipative paint having a thickness of about 0.7 to about 0.9 mils.

DESCRIPTION OF THE PREFERRED EMBODIMENT

Figure 1:
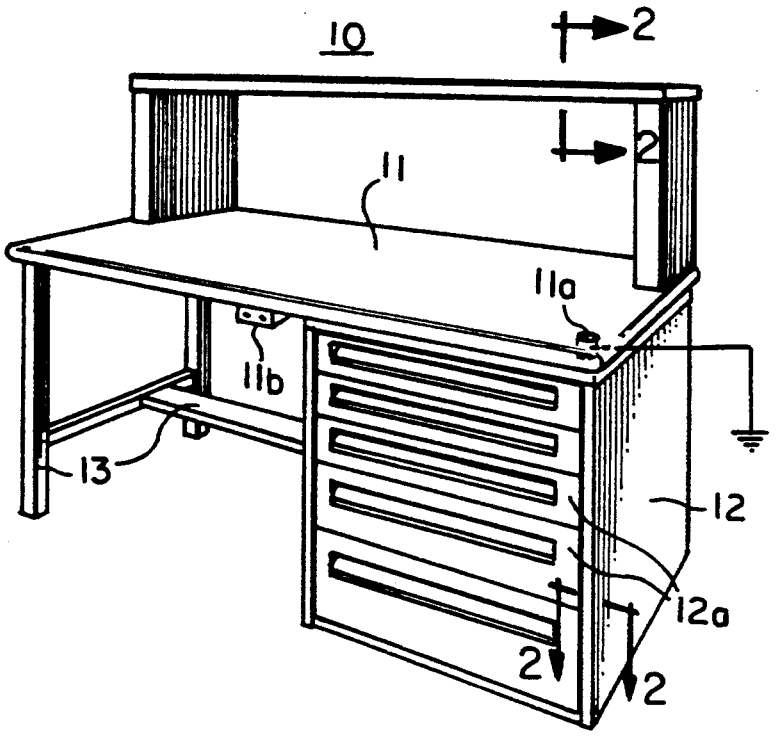
FIG. 1 is a perspective view of an electrostatic discharge workstation embodying the present invention.

Referring to FIG. 1 there is illustrated a basic electrostatic discharge protective workstation 10 embodying the present invention. The workstation 10 includes an electrostatic discharge protective worksurface 11 mounted on a cabinet 12 which in cooperation with legs 13 provide a support for the worksurface 11. Cabinet 12 includes a plurality of drawers 12*a* or shelves if desired. Mounted on top of the worksurface 11 is a shelf 14.

The worksurface 11 preferably is a 1¾" thick laminate top with a full radius front edge and a static dissipative surface which conforms to NEMA LD-3-1991 Standards for PF-42 grade laminated. Worksurface material of this type is manufactured by NEVAMAR, 3M, FORMICA and other worksurface manufacturers and laminators. The other parts of the workstation 10 including the cabinet 12, the drawers or shelves 12*a* thereof, the supports 13 and the shelf 14 are all made of metal, namely steel. Each of these metal parts is provided with surface coatings in accordance with the present invention as hereinafter described.

As pointed out above, resistance has been selected as the best single predictor of performance of ESD-protective worksurfaces. The EOS/ESD standard, referred to above, for resistivity or static dissipative ranges for this type of equipment is point-to-point resistance of $10^6$ to $10^{10}$ ohms and point-to-ground resistance of $10^6$ to $10^{10}$ ohms at 10 V DC and 100 V DC. Numbers lower than 106 represent a more conductive material while numbers higher than $10^{10}$ represent less conductive material. The middle range of $10^6$ to $10^{10}$ represents the ideal value of a material that tends to be non-static generating and static dissipative or semi-conductive.

It was found that the foregoing resistivity ranges could be achieved if the metal cabinets, drawers and shelves of the workstation are treated in the following manner. First, the metal parts of the cabinets, drawers and shelves are subjected to a precleaning operation where the parts are (a) immersed in a phosphate solution, (b) rinsed, and (c) a sealer is applied to the surfaces of the parts. An example of a suitable sealer is a phosphoric acid sealer sold by PPG Industries, Inc. under the tradename "Chemseal 6" which contains 25–35% phosphoric acid, the balance water and <1% organic additive. The precleaned parts are then dried off in an oven. It has been found that a period of about 7 min. at an oven temperature of 400° F. is adequate for the drying step. After the parts have been dried, the surfaces of the metal parts have applied thereto a dielectric base coating adequate to provide a thickness of about 0.4 to about 0.6 mils. when measured dry. In a particular example, the base coating paint was gray and had a viscosity of 15–16 secs. at 80° F. with a #3 Zahn cup. The base coating was cured on the metal part for about 18 minutes at 325° F. Thereafter the base coated metal part was coated with an electrostatic dissipative paint to a thickness of about 0.7 to about 0.9 mils (measured dry). In a particular example the electrostatic dissipative paint was black with non-flaking carbon impregnated and having a viscosity of about 18 secs. at 80° F. with a

#3 Zahn cup. The metal part coated with the electrostatic dissipative paint was cured for about 18 min. at 325° F.

Figure 2:
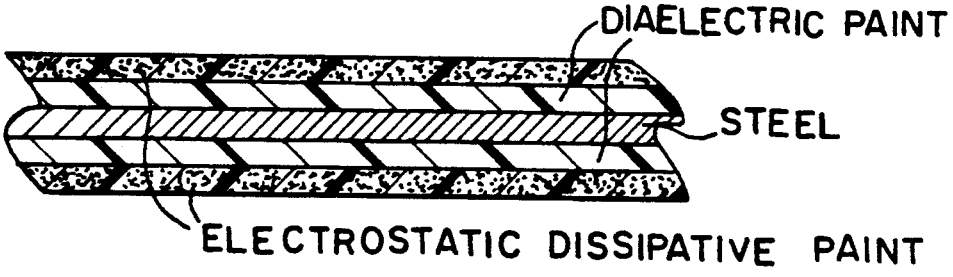
FIG. 2 is a sectional view on greatly enlarged scale taken along the lines 2—2 in FIG. 1.

In FIG. 2 there is illustrated in cross section a section of one of the steel parts or sheet which form the cabinet drawers or shelves and has the aforesaid coatings applied thereto. It will be noted that the coatings are applied to both surfaces of the steel part. Directly on the surface of the steel part is applied the dielectric coating described above. On top of the dielectric coating is applied the electrostatic dissipative coating described above. An example of the dielectric base coat is an insulative high solids, thermoset baking enamel available commercially from PPG Industries under the name "Vidmar Gray High Solids Enamel" having the following ingredients:

| INGREDIENTS | CAS NUMBER | % WEIGHT |
|---|---|---|
| Titanium Dioxide | 13463-67-7 | 20–25 |
| Barium Sulfate | 7727-43-7 | 10–15 |
| Silica, Crystalline Quartz | 14808-60-7 | 2–5 |
| Light Aromatic Solvent Naphtha | 64742-95-6 | 10–15 |
| Xylene | 1330-20-7 | 5–10 |
| Film Formers, Resins, and Additives | Not Established | 45–50 |

An example of the electrostatic dissipative coat is a conductive high solids, thermoset baking enamel available commercially from PPG Industries, Inc. under the name "Conductive Black High Solids Enamel" having the following ingredients:

| INGREDIENTS | CAS NUMBER | % WEIGHT |
|---|---|---|
| Lampblack #6 | 1333-86-4 | 2–5 |
| 2,2,4-Trimethyl-1,3-Pentanediol | 144-19-4 | 2–5 |
| Light Aromatic Solvent Naphtha | 64742-95-6 | 15–20 |
| Normal Butyl Alcohol | 71-36-3 | 2–5 |
| Film Formers, Resins, and Additives | Not Established | 65–70 |

In an electrostatic discharge protective workstation it is necessary that all of the parts thereof be connected to a true earth ground. In order to accomplish this in a convenient manner, it will be noted in FIG. 1 that the worksurface 11 is provided with a common grounding point 11a which goes directly to ground. Each of the other parts of the workstation including the cabinet 12 and drawers **12*a* as well as the support 13 and shelf 14 are internally connected to the common grounding point 10*a*. Thus the entire system of the workstation is connected to ground through the common grounding point 10*a*. It is also necessary that an electrostatic discharge protective workstation include an operator wrist strap which must be grounded and in FIG. 1 there is illustrated a plug-in grounding receptacle 11*b* which also is internally connected to the common grounding point 11*a*** of the workstation.

While the present invention has been described in connection with a complete workstation it is to be understood that the invention is also applicable to cabinets per se that do not form part of a complete workstation. For example, the cabinet 12 illustrated in FIG. 1 may be manufactured and sold as a separate component and not part of a workstation configuration as shown in FIG. 1. The single cabinet 12 would be manufactured in the same manner as described above and the steel parts or sheet from which the cabinet drawers or shelves are formed would have the dielectric paint and electrostatic dissipative paint coatings applied thereto as illustrated in FIG. 2. Thus it will be seen that the present invention is not limited to a complete workstation configuration.

While there has been described a preferred embodiment of the invention, it will be understood that further modifications may be made without departing from the spirit and scope of the invention as set forth in the appended claims.

What is claimed is:

1. A method of making the metal components for an electrostatic discharge protective workstation comprising at least one metal cabinet having drawers and/or shelves conform with the standard resistivity ranges for static dissipative control point-to-point resistance of $10^6$–$10^{10}$ ohms and point-to-common point ground resistance to $10^6$–$10^{10}$ ohms at 10 V DC and 100 V DC comprising the steps of precleaning and drying the metal parts of the cabinet, coating the metal parts with a dielectric base paint coat to a thickness of about 0.4 to about 0.6 mils measured dry after curing, and thereafter coating the base coated metal parts with an electrostatic dissipative paint to a thickness of about 0.7 to about 0.9 mils measured dry after curing.

2. The method according to claim 1 wherein the electrostatic dissipative paint is carbon impregnated and black.

3. The method according to claim 1 wherein the dielectric base paint coating has a viscosity of 15–16 secs. at 80° F. with a #3 Zahn cup and is cured on the metal parts for about 18 minutes at about 325° F.

4. The method according to claim 2 wherein the electrostatic dissipative black paint to be applied to the base coated metal parts has a viscosity of about 18 secs. at 80° F. with a #3 Zahn cup and is cured on the base coated metal parts for about 18 minutes at 325° F.

5. The method according to claim 4 wherein the metal parts of the cabinet are precleaned by phosphate immersion, rinsed and sealed and thereafter dried in an oven for about 7 minutes at about 400° F.

6. An electrostatic discharge protective workstation comprising metal cabinets, drawers and shelves constructed for a static-safe work environment so that the metal cabinet, drawers and shelves conform with the standard resistivity ranges for static dissipative control point-to-point resistance of $10^6$–$10^{10}$ ohms and point-to-point common ground resistance of $10^6$–$10^{10}$ ohms at 10 V DC and 100 V DC wherein the metal parts of the cabinets, drawers and shelves have a dielectric base paint coat of a thickness of about 0.4 to about 0.6 mils and an outer coat of an electrostatic dissipative paint having a thickness of about 0.7 to about 0.9 mils.

7. An electrostatic discharge protective workstation according to claim 6 wherein the coating of electrostatic dissipative paint is carbon impregnated and black.

8. A method of making a metal cabinet having drawer and/or shelves suitable for use in an electrostatic discharge protective workstation conform with the standard resistivity ranges for static dissipative control point-to-point resistance of $10^6$–$10^{10}$ ohms and point-to-common point ground resistance to $10^6$–$10^{10}$ ohms at 10 V DC and 100 V DC comprising the steps of precleaning and drying the metal parts of the cabinet, coating the metal parts with a dielectric base paint coat to a thickness of about 0.4 to about 0.6 mils measured dry after curing, and thereafter coating the base coated metal parts with an electrostatic dissipative paint to a thickness of about 0.7 to about 0.9 mils measured dry after curing.

9. The method according to claim 8 wherein the electrostatic dissipative paint is carbon impregnated and black.

10. The method according to claim 8 wherein the dielectric base coating has a viscosity of 15–16 secs. at 80° F. with a #3 Zahn cup and is cured on the metal parts for about 18 minutes at about 325° F.

11. The method according to claim 9 wherein the electrostatic dissipative black paint to be applied to the base coated metal parts has a viscosity of about 18 secs. at 80° F. with a #3 Zahn cup and is cured on the base coated metal parts for about 18 minutes at 325° F.

12. The method according to claim 11 wherein the metal parts of the cabinet drawers and shelves are precleaned by phosphate immersion, rinsed and sealed and thereafter dried in an oven for about 7 minutes at about 400° F.

13. An electrostatic discharge protective metal cabinet having drawers and/or shelves constructed for a static-safe work environment so that the metal cabinet conforms with the standard resistivity ranges for static dissipative control point-to-point resistance of $10^6$–$10^{10}$ ohms and point-to-point common ground resistance of $10^6$–$10^{10}$ ohms at 10 V DC and 100 V DC wherein the metal parts of the cabinet have a dielectric base paint coat of a thickness of about 0.4 to about 0.6 mils and an outer coat of an electrostatic dissipative paint having a thickness of about 0.7 to about 0.9 mils.

14. An electrostatic discharge protective metal cabinet according to claim 13 wherein the coating of electrostatic dissipative paint is carbon impregnated and black.

* * * * *